US006476771B1

(12) United States Patent
McKinzie, III

(10) Patent No.: US 6,476,771 B1
(45) Date of Patent: Nov. 5, 2002

(54) ELECTRICALLY THIN MULTI-LAYER BANDPASS RADOME

(75) Inventor: William E. McKinzie, III, Fulton, MD (US)

(73) Assignee: E-Tenna Corporation, Laurel, MD (US)

( * ) Notice: Subject to any disclaimer, the term of this patent is extended or adjusted under 35 U.S.C. 154(b) by 0 days.

(21) Appl. No.: 09/883,828

(22) Filed: Jun. 14, 2001

(51) Int. Cl.[7] ..... H01Q 19/00

(52) U.S. Cl. ..... 343/756; 343/909; 333/134; 333/202

(58) Field of Search ..... 343/756, 722, 343/745, 749, 909; 333/134, 202, 167, 168; 505/210

(56) References Cited

U.S. PATENT DOCUMENTS

| | | | | | |
|---|---|---|---|---|---|
| 4,899,164 | A | | 2/1990 | McGrath | 343/754 |
| 5,208,603 | A | | 5/1993 | Yee | 343/909 |
| 5,473,334 | A | * | 12/1995 | Yee et al. | 343/756 |
| 6,049,308 | A | | 4/2000 | Hietala et al. | 343/700 MS |
| 6,052,078 | A | | 4/2000 | Waterman | 342/5 |
| 6,121,931 | A | * | 9/2000 | Levi | 343/700 MS |
| 6,147,572 | A | * | 11/2000 | Kaminski et al. | 333/134 |
| 6,175,337 | B1 | | 1/2001 | Jasper, Jr. et al. | 343/770 |
| 6,178,339 | B1 | * | 1/2001 | Sakai et al. | 505/210 |
| 6,208,316 | B1 | * | 3/2001 | Cahill | 333/134 |
| 6,218,978 | B1 | * | 4/2001 | Simpkin et al. | 342/5 |

FOREIGN PATENT DOCUMENTS

WO WO 99/50929 3/1999

OTHER PUBLICATIONS

Broas, Romulo Francis Jimenez, "Experimental Characterization of High Impedance Electromagnetic Surfaces in the Microwave Frequency Regime," Thesis submitted to the University of California, Los Angeles, 1999.

Diaz, Rodolfo E., et al., "TM Mode Analysis of a Sievenpiper High–Impedance Reactive Surface," Submitted to the 2000 IEEE AP–S International. Symposium, Salt Lake City, Utah, Jul. 16–21, 2000.

Diaz, Rodolfo E., et al., "TM Mode of a Sievenpiper High–Impedance Reactive Surface," 2000 IEEE AP–S International Symposium, Salt Lake City, Utah, Jul. 16–21.

Fries, Matthias, et al., "Small Microstrip Patch Antenna Using Slow–Wave Structure," IEEE AP–S International Symposium, Salt Lake City, Utah, Jul. 16–21, 2000.

(List continued on next page.)

*Primary Examiner*—Tan Ho

(74) *Attorney, Agent, or Firm*—Knobbe, Martens, Olson & Bear LLP

(57) ABSTRACT

A bandpass radome that reduces the number of spurious resonances, and that tends to suppress Transverse Magnetic TM and Transverse Electric TE surface waves, is described. In one embodiment, the radome includes an inductive FSS ground plane layer. First and second capacitive FSS layers are disposed above the inductive ground plane layer. Third and fourth capacitive FSS layers are disposed below the inductive ground plane layer. In one embodiment, the capacitive FSS layers use patch elements and some or all of the FSS patch elements above and below the inductive ground plane layer are electrically connected to the inductive ground plane layer by a conducting posts. The conducting posts form a rodded medium to suppress TM and TE surface waves. In one embodiment the total thickness of the bandpass radome is less than $\lambda/20$ at the center frequency of the passband.

25 Claims, 19 Drawing Sheets

OTHER PUBLICATIONS

Kim, M., et al., "A Rectangular TEM Waveguide with Photonic Crystal Walls for Excitation of Quasi–Optical Amplifiers," IEEE, MTT–S Symposium, May 1999.
King, J., et al., "Synthesis of Surface Reactances Using Grounded Pin Bed Structure," Nov. 25, 1980.
King, Ray J., et al., "The Synthesis of Surface Reactance Using an Artificial Dielectric," IEEE, May, 1983, p. 471–476.
Ma, K.P., et al., "Using Novel Photonic Bandgap Structure," Electronic Letters, vol. 34, No. 21, Oct., 1993.
Poilasne, G., et al., "Antennas and High Impedance Ground Planes with No Surface Wave," Progress in Electromagnetics Research Symposium, Cambridge, MA, Jul. 5–14, 2000.
Poilasne, G., et al., "Matching Antennas Over High Impedance Ground Planes," 2000 IEEE AP–S International Symposium, Salt Lake City, Utah, Jul. 16–21, 2000, p. 312.
Qian, Yongxi, et al., "Planar Periodic Structures for Microwave and Millimeter Wave Circuit Applications," IEEE, May, 1999.
Rahman, M., et al., "Equivalent Circuit Model of 2D Microwave Photonic Band Gap Structure," IEEE APS/URSI, May 20, 2000.
Rahman, M., et al., "Equivalent Circuit Model of 2D Microwave Photonic Band Gap Structure," IEEE AP–S/URSI Symposium, Jul. 16–20, 2000.
Remski, Richard, "Modeling Photonic Bandgap (PBG) Structures Using Ansoft HFSS 7 and Optimetrics," Ansoft HFSS International Roadshow, Aug.–Oct., 2000.
Remski, Richard, "Analysis of Photonic Bandgap Surfaces Using Ansoft HFSS," Microwave Journal, Sep. 2000, p. 190–198.
Sievenpiper, D., et al., "High–Impedance Ground Plane," Electronic Letters, vol. 36, No. 16, Aug., 2000.
Sievenpiper, Dan, et al., "High–Impedance Electromagnetic Surfaces with a Forbidden Frequency Band," IEEE Transactions on Microwave Theory and Techniques, vol. 47, No. 11, Nov., 1999, p. 2059–2074.
Sievenpiper, D., et al., "Antennas on High–Impedance Ground Planes," IEEE, 1999.
Sievenpiper, D., et al., "High–Impedance Electromagnetic Ground Planes," IEEE MTT–S Symposium, May, 1999.
Sievenpiper, Daniel Frederic, "High–Impedance Electromagnetic Surfaces," Dissertation submitted to the University of California, Los Angeles, 1999.
Walser, Rodger M., et al., "New Smart Materials for Adaptive Microwave Signature Control," SPIE, vol. 1916, p. 128–139, 1993.
Yang, Frei–Ran, et al., "A Novel Low–Loss Slow–Wave Microstrip Structure," IEEE Microwave and Guided Wave Letters, vol., 8, No. 11, Nov. 1998, p. 372–374.
Yang, Frei–Ran, et al., "A Uniplanar Compact Photonic–Bandgap (UC–PBG) Structure and its Applications for Microwave Circuits," IEEE Transactions on Microwave Theory and Techniques, vol. 47, No. 8, Aug. 1999, p. 1509–1514.
Zhang, L., et al., "An Efficient Finite–Element Method for the Analysis of Photonic Band–Gap Materials," IEEE MTT–S Symposium, May, 1999.

* cited by examiner

Field Components: $H_x$, $H_z$, and $E_y$

ELECTRICALLY THIN MULTI-LAYER BANDPASS RADOME

BACKGROUND OF THE INVENTION

1. Field of the Invention

The present invention relates to bandpass radomes constructed using frequency selective surfaces.

2. Description of the Related Art

Bandpass radomes built using Frequency Selective Surfaces typically use FSS elements that are approximately $\lambda/2$ in their largest dimension at the resonant frequency of the radome. Such half-wave elements typically exhibit multiple resonances, such that at normal incidence a radome having a resonance at $f_0$ will typically exhibit spurious resonances at $3f_0$, $5f_0$, etc. At oblique incidence, spurious resonances will also typically occur at $2f_0$, $4f_0$, etc. Moreover, such FSS radomes will also excite surface waves that travel along the surface of the radome and shed energy to produce pattern anomalies in the pattern of an antenna placed behind the radome.

SUMMARY

The present invention solves- these and other problems by providing a bandpass radome that reduces the number of spurious resonances. Moreover, the present bandpass radome tends to suppress Transverse Magnetic (TM) and Transverse Electric (TE) surface waves over various frequency bands. In one embodiment, the bandpass radome uses high surface impedance frequency selective surfaces in a structure that is electrically thin (typically $\lambda/100$ to $\lambda/50$ in thickness at resonance).

In one embodiment, the radome includes a slotted FSS ground plane layer. First and second FSS patch layers are disposed above the slotted ground plane layer. Third and fourth FSS patch layers are disposed below the slotted ground plane layer. In one embodiment, each of the FSS patch layers above and below the slotted ground plane layer are electrically connected to the slotted ground plane layer by a conducting post. The conducting posts form a rodded medium. In one embodiment, the conducting posts suppress TM and TE surface waves.

In one embodiment, the FSS patch layers above and below the ground plane use square patches. In one embodiment, the square patches have rebated comers to provide clearance for the conducting posts. In one embodiment, the conducting posts are plated-through holes. In one embodiment, a dielectric layer having a first thickness separates the FSS layers above the ground plane from each other. In one embodiment, a dielectric layer having a second thickness separates the FSS layer above the ground plane and closest to the ground plane from the ground plane. In one embodiment, a dielectric layer having a third thickness separates the ground plane from the FSS layer below the ground plane that is closest to the ground plane. In one embodiment, a dielectric layer having a fourth thickness separates the two FSS layers that are below the ground plane.

In one embodiment, a plurality of capacitive FSS layers is disposed above a slotted FSS ground plane and a plurality of capacitive FSS layers is disposed below the slotted FSS ground plane. The slotted ground plane is inductive at the resonant frequency of the radome. In one embodiment, a plurality of FSS elements above the ground plane are electrically connected to the ground plane by conducting posts.

DESCRIPTION OF THE FIGURES

The above and other aspects, features, and advantages of the present invention will be more apparent from the following description thereof presented in connection with the following drawings.

Figure 1:
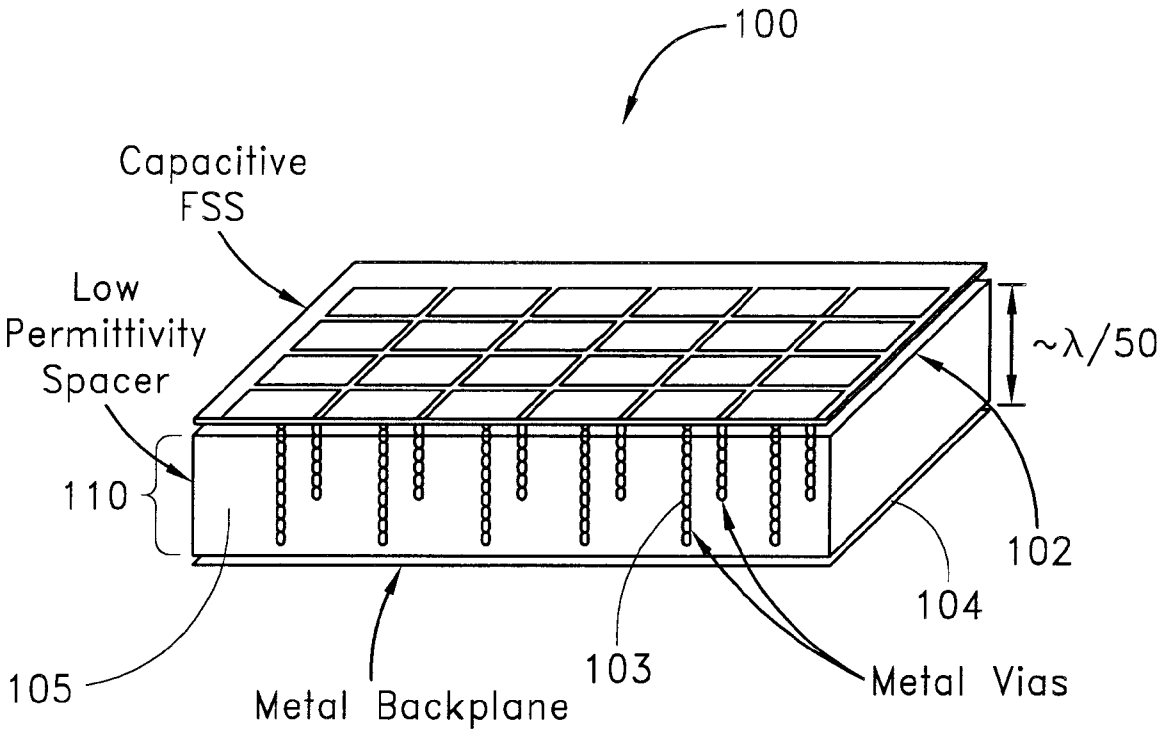
FIG. 1 shows a Sievenpiper high-impedance surface.

In the drawings, the first digit of any three-digit element reference number generally indicates the number of the figure in which the referenced element first appears. The first two digits of any four-digit element reference number generally indicate the number of the figure in which the referenced element first appears.

DETAILED DESCRIPTION

High impedance FSS surfaces are typically used in applications where reduced aperture size and weight are desired. A high impedance surface is typically a relatively lossless reactive surface, whose equivalent surface impedance, $Z_S=E_{tan}/H_{tan}$, approximates an open circuit, and which inhibits the flow of equivalent tangential electric surface currents, thereby approximating a zero tangential magnetic field, $H_{tan}\approx 0$.

High impedance surfaces have been used by antenna engineers in various antenna applications. For example, corrugated horns are specially designed to offer equal E and H plane half power beamwidths. However, in these applications, the corrugations or troughs are made of metal where the depth of the corrugations is one quarter of a free space wavelength. At high microwave frequencies, $\lambda/4$ is a small dimension, but at UHF frequencies (300 MHz to 1 GHz), or even at low microwave frequencies (1–3 GHz), $\lambda/4$ can be quite large.

One embodiment of a thin high-impedance surface is a Sievenpiper surface 100 shown in FIG. 1 (see e.g. Daniel F. Sievenpiper, "High-Impedance Electromagnetic Surfaces", Ph.D. dissertation, UCLA 1999). The Sievenpiper surface 100 is an electrically-thin, planar, periodic structure, with vertical and horizontal conductors, which can be fabricated using low cost printed circuit technologies. In the Sievenpiper surface 100, an upper layer 102 is a periodic array of metal patches that form an effective sheet capacitance. Thus, the upper layer 102 is a capacitive frequency selective surface (FSS). Each patch is connected to a conducting ground plane 104 by a conducting via 103, which can be a plated through hole. The periodic array of conducting vias is a rodded media. The vias 103 pass through a dielectric layer 105, which is typically a relatively low permittivity dielectric material typical of many printed circuit board substrates.

The region occupied by the vias 103 and the dielectric layer 105 is referred to collectively as a spacer layer 110. The spacer layer 110 has a height h that is typically 10 to 40 times thicker than the thickness t of the FSS layer 102. The dimensions of a unit cell in the Sievenpiper high-impedance surface are typically much smaller than the wavelength $\lambda$ at the desired operating frequency. The period of the elements in the FSS layer 102 is typically between $\lambda/40$ and $\lambda/12$.

A Sievenpiper high-impedance surface constructed with printed circuit technology can be made much lighter than a corrugated metal waveguide (which is typically machined from a block of aluminum). Moreover, the printed circuit version can be 10 to 100 times less expensive for the same frequency of operation. The Sievenpiper design offers a high surface impedance for both x and y components of tangential electric field (where the surface 102 lies in the xy plane), which is not possible with a corrugated waveguide. Corrugated waveguides offer a high surface impedance for one polarization of electric field only.

The Sievenpiper high-impedance surface also provides height reduction as compared to a corrugated metal waveguide. A Sievenpiper design, which is typically $\lambda/50$ in total thickness, is 12.5 times thinner than an air-filled corrugated metal waveguide. Dielectric loading in the corrugations can decrease this advantage, but it also adds the penalty of weight and cost to the corrugated waveguide.

A high-impedance surface is useful because it offers a boundary condition which permits wire antennas (electric currents) to be well matched and to radiate efficiently when the wires are placed in very close proximity to this surface ($<\lambda/100$ away). By contrast, if the same wire antenna is placed very close to a perfect electric conductor (PEC) surface, the antenna will usually not radiate efficiently due to a severe impedance mismatch. The radiation pattern from the antenna near a high-impedance surface is, for the most part, confined to the upper half space, and the performance is relatively unaffected even if the high-impedance surface is placed on top of another metal surface.

Figure 2:
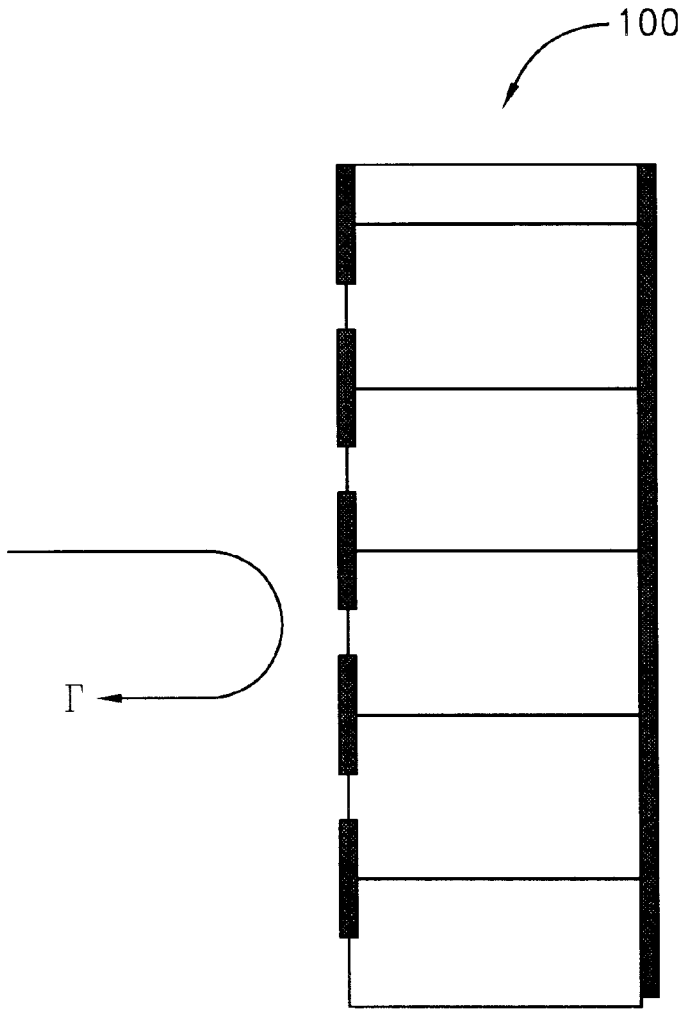
FIG. 2 illustrates reflection from the Sievenpiper high-impedance surface shown in FIG. 1.
Figure 3:
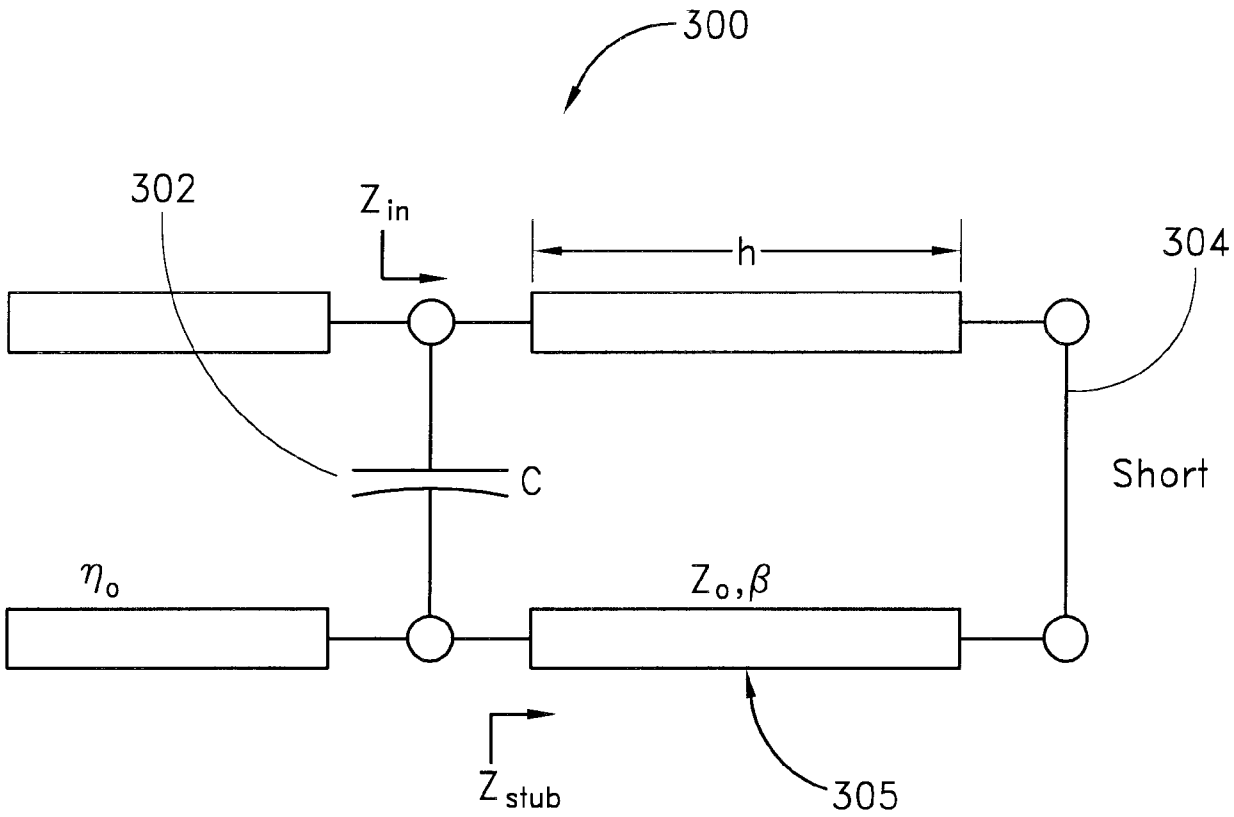
FIG. 3 illustrates an equivalent circuit of the Sievenpiper high-impedance surface near normal incidence.
Figure 4:
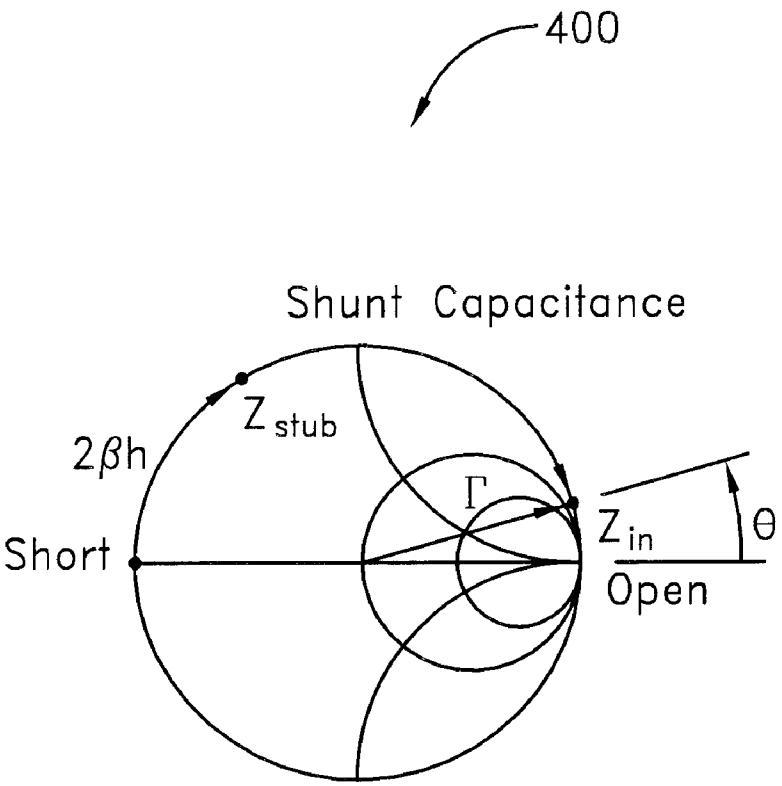
FIG. 4 is a Smith chart showing the impedance transformation of the ground plane short to the surface of the Sievenpiper high-impedance surface.

FIG. 2 illustrates plane waves normally incident upon the Sievenpiper surface 100. The reflection coefficient referenced to the surface is shown as $\Gamma$. The Sievenpiper surface 100 has an equivalent TEM mode transmission line equivalent circuit 300 shown in FIG. 3. The capacitive FSS 102 is modeled as a shunt capacitance C 302 and the dielectric slab 105 is modeled as a transmission line 305 of length h which is terminated in a short circuit 304 corresponding to the ground plane 104. FIG. 4 shows a Smith chart 400 in which the short is transformed into the stub impedance $Z_{tub}$ just below the FSS layer 102. The admittance of this stub line is added to the capacitive susceptance of the capacitor 302 to create a high impedance $Z_{in}$ at the surface 104. The $Z_{in}$ locus on the Smith Chart 4 will always be found on the unit circle so long as the Sievenpiper surface 100 is lossless and operated at a frequency below the first grating lobe. Under such conditions, $Z_{in}$, has a magnitude of unity.

Figure 5:
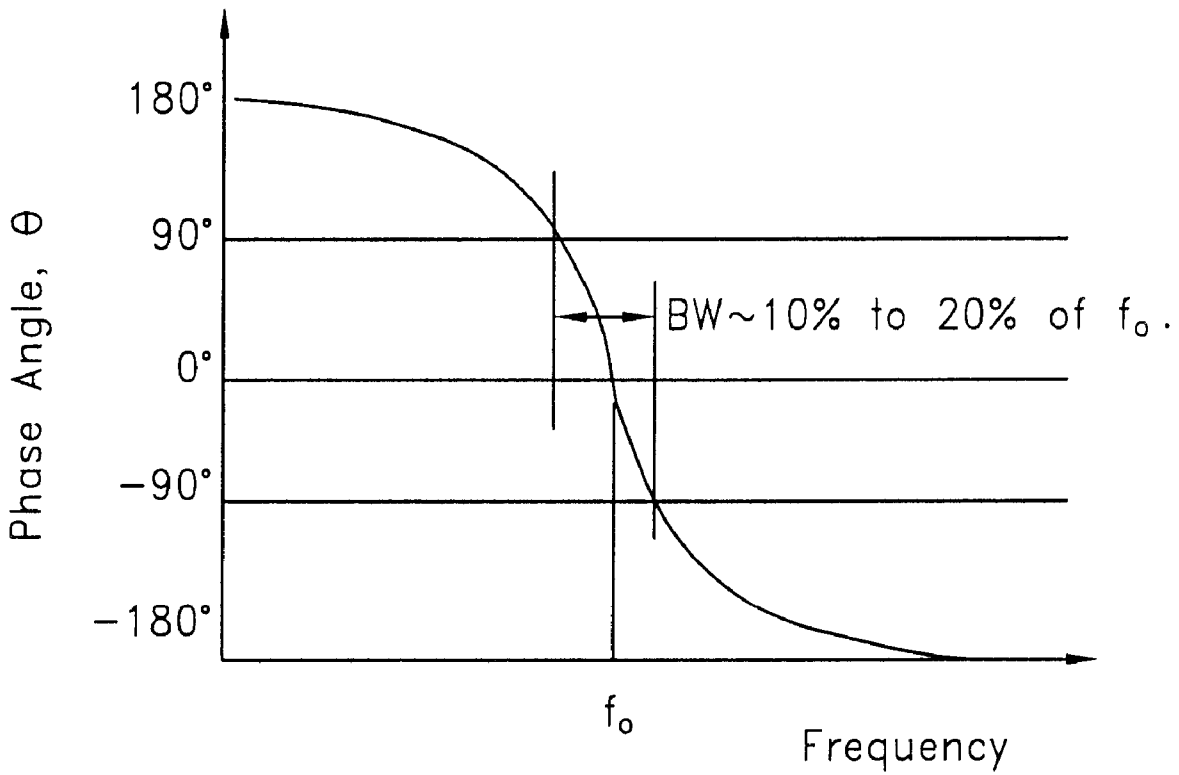
FIG. 5 is a phase plot for the reflection coefficient of the Sievenpiper high-impedance surface as a function of frequency.

The reflection coefficient F has a phase angle $\theta$, which sweeps from 180° at DC, through 0° at the center of the high impedance band, and rotates into negative angles at higher frequencies where it becomes asymptotic to 180°, as shown in FIG. 5. Resonance is defined as the frequency corresponding to 0° reflection phase. The reflection phase bandwidth is defined as that bandwidth between the frequencies corresponding to the +90° and 90° phases. This reflection phase bandwidth also corresponds to the range of frequencies where the magnitude of the surface reactance exceeds the impedance of free space: $|X|\geqq 377$ ohms.

Over certain frequency ranges, the Sievenpiper surface 100 is a good approximation to a perfect magnetic conductor (PMC). A PMC is a mathematical boundary condition where the tangential magnetic field on the boundary is forced to zero. It is the electromagnetic dual to a perfect electric conductor (PEC) where the tangential electric field is zero. A PMC can be used as a mathematical tool to model electromagnetic problems for slot antenna analysis. Technically, PMCs are not known to exist. However, the Sievenpiper high-impedance surface is a good approximation to a PMC over a limited band of frequencies defined by the +/−90° reflection phase bandwidth. So in recognition of its limited frequency bandwidth, the Sievenpiper high-impedance surface is referred to as an artificial magnetic conductor, or AMC.

Figure 6:
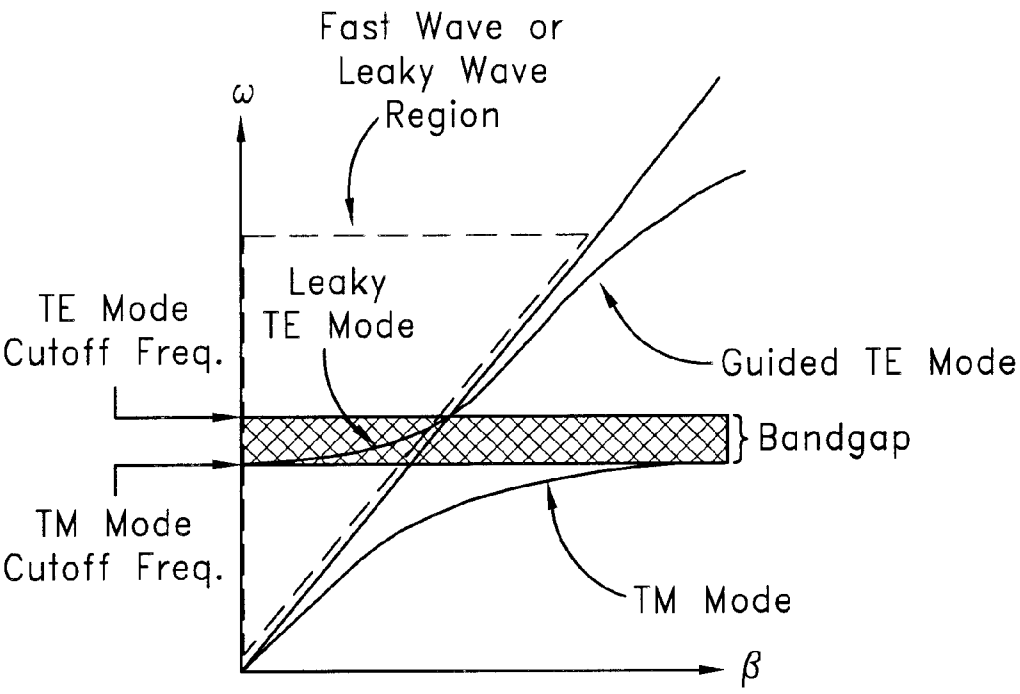
FIG. 6 is an omega-beta diagram for surface waves on a Sievenpiper high-impedance surface.

The artificial magnetic conductor AMC provides, over some frequency band, a high surface impedance to plane waves. The AMC also provides a surface wave bandgap over which bound, guided TE and TM modes do not propagate. The dominant TM mode is cutoff and the dominant TE mode is leaky in the bandgap. The bandgap property is shown in FIG. 6 as an $\omega\beta$ $\omega$ versus $\beta$) diagram. The bandgap property is useful for antenna applications because it is the leakage of the TE mode, excited by the wire antenna, which appears to make bent-wire monopoles on the Sievenpiper AMC a practical antenna element. Leakage of the surface wave dramatically reduces the diffracted energy from the edges of the AMC surface in antenna applications. So the radiation pattern from small AMC ground planes can be essentially confined to one hemisphere. The environment behind the AMC is essentially shielded from radiation. Both the high impedance and the bandgap properties of the AMC occur in the same frequency range. Thus, the resonant frequency for reflection phase (0° frequency) is usually placed near the center of the bandgap.

Figure 7:
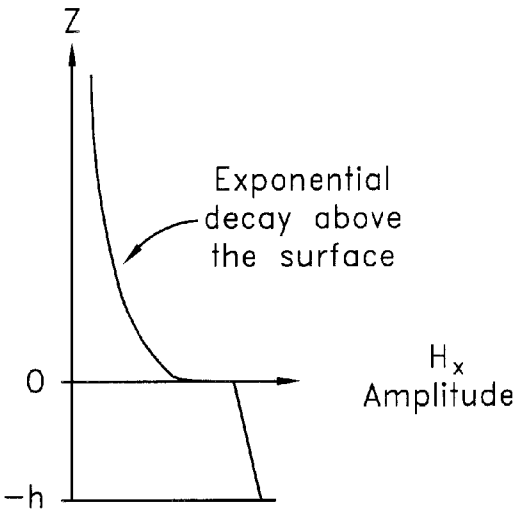
FIG. 7 shows transverse electric (TE) mode fields near a Sievenpiper high-impedance surface.
Figure 7:
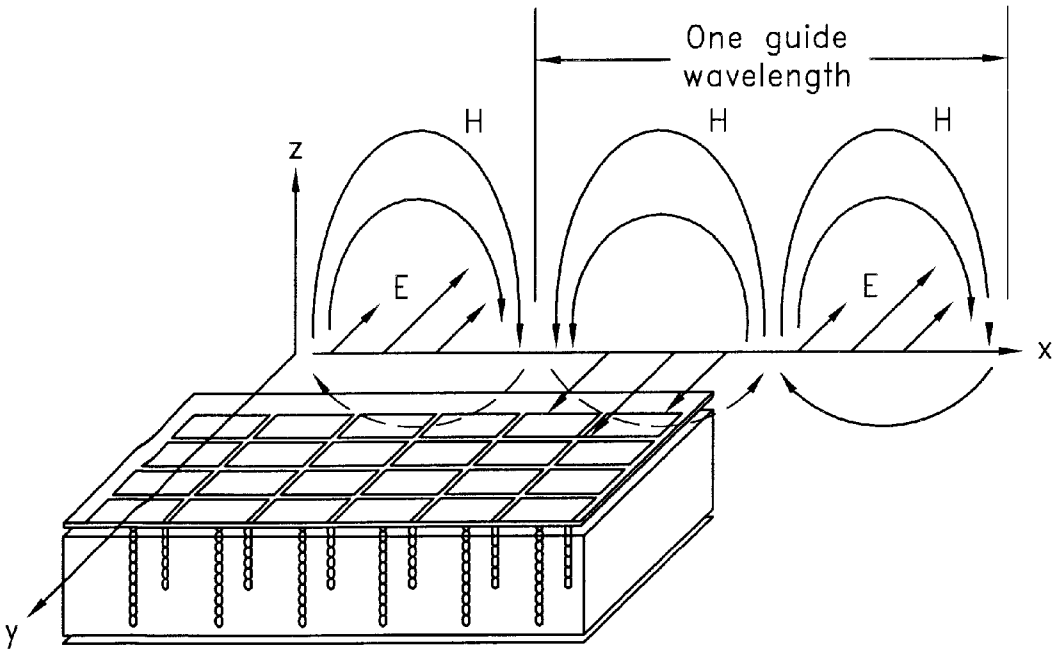
Figure 8:
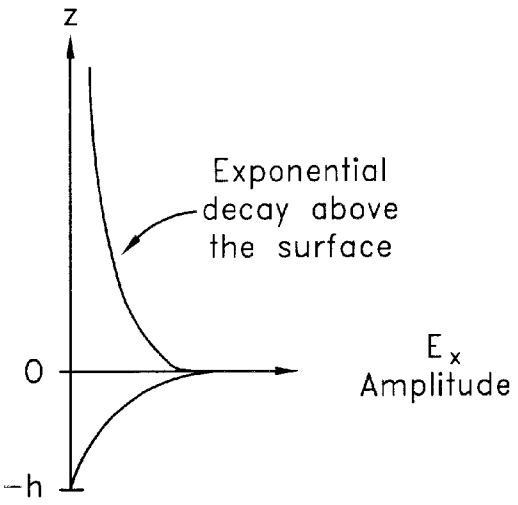
FIG. 8 shows transverse magnetic (TM) mode fields near a Sievenpiper high-impedance surface.
Figure 8:
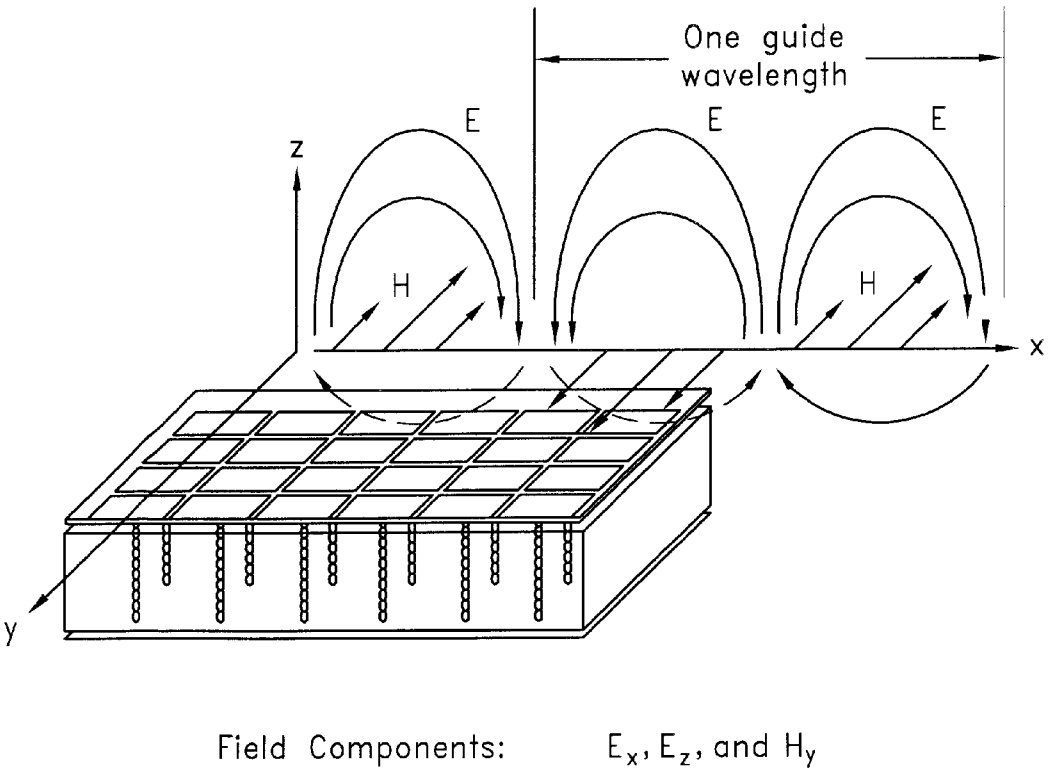

FIG. 7 illustrates the E and H fields associated with TE surface wave modes about the Sievenpiper surface 100. FIG. 8 illustrates the E and H fields associated with TM surface wave modes about the Sievenpiper surface 100.

Figure 9A:
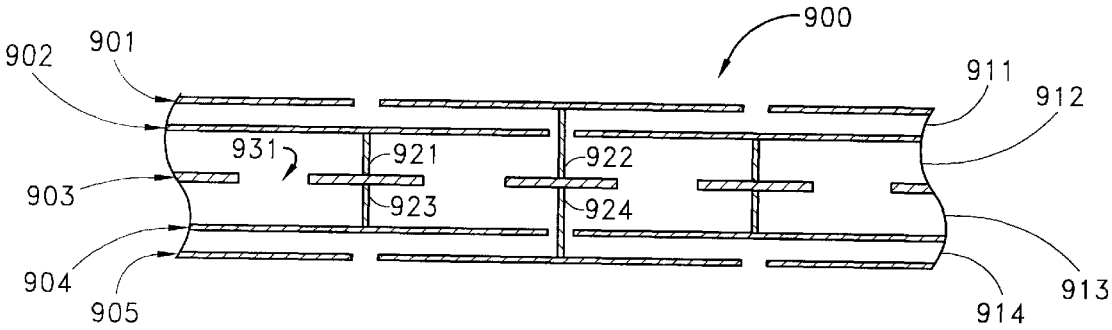
FIG. 9A shows an edge view of a bandpass radome based on a pair of Sievenpiper high-impedance surfaces.
Figure 9B:
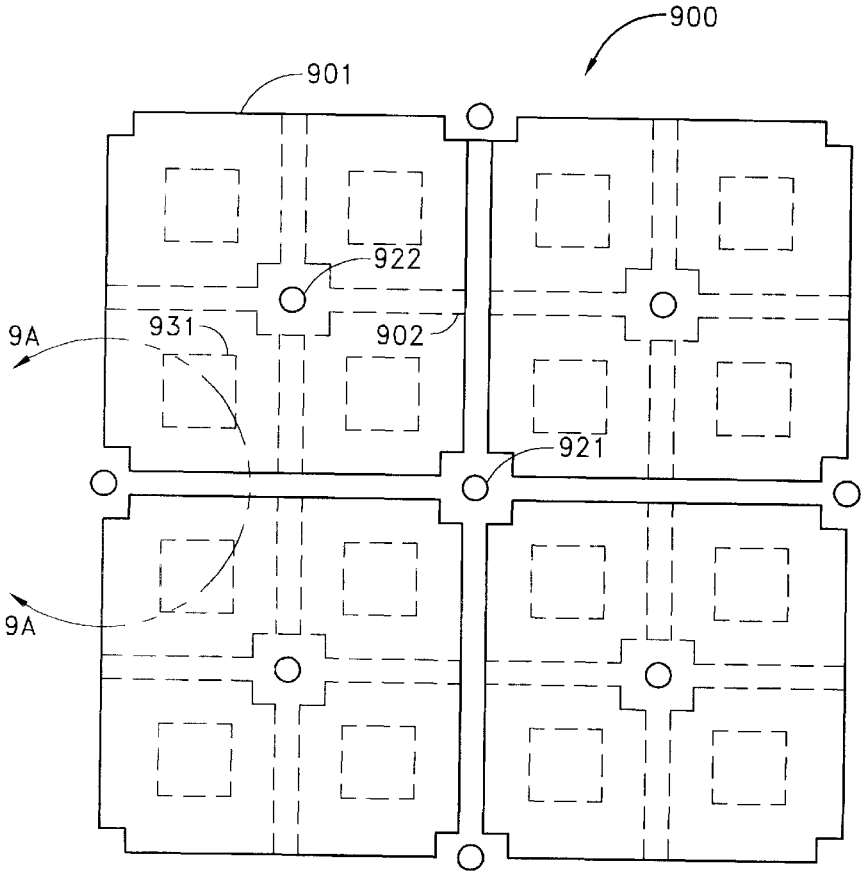
FIG. 9B shows a plan view of the bandpass radome shown in FIG. 9A.

The advantages of the Sievenpiper surface 100 can be incorporated into a radome structure by turning two Sievenpiper surfaces back to back (about a common ground plane) and providing coupling apertures in the ground plane. FIG. 9A shows an edge view of a bandpass radome 900 based on two Sievenpiper high-impedance surfaces. FIG. 9B shows a plan view of the bandpass radome 900 shown in FIG. 9A. The radome 900 includes an upper-outer FSS surface 901. An upper-inner FSS surface is provided below the upper-outer FSS surface 901. The surfaces 901 and 902 are separated by a dielectric layer 911. Conducting vias 921 connect elements of the surface 902 to a slotted ground -plane 903. Conducting vias 922 connect elements of the surface 911 to the slotted ground plane 903. A dielectric layer 912 separates the surface 902 from the ground plane 903 and supports the vias 921 and 922.

Below the ground plane 903, a dielectric layer 913 separates the ground plane 903 from an inner-lower FSS 904. A dielectric layer 914 separates the inner-lower FSS 904 from an outer-lower FSS surface 905. Vias 923 connect elements of the inner-lower FSS 904 to the ground plane 903, and vias 924 connect elements of the outer-lower FSS 905.

In one embodiment, elements of the FSS layer 901 are similar to elements of the FSS layer 905. In one embodiment, elements of the FSS layer 902 are similar to elements of the FSS 904. In one embodiment, elements of the FSS layers 901, 902, 904, and 905 are similar. In one embodiment, the dielectric layers 911 and 914 are similar. In one embodiment, the dielectric layers 912 and 913 are similar. In one embodiment, the radome 900 is symmetric about the ground plane 903. In one embodiment, the vias 921 and 923 are omitted. In one embodiment, the vias 922 and 924 are omitted.

In one embodiment the FSS elements of the FSS layers 901, 902, 904 and 905 are square patches with a portion the comers of each patch rebated to provide clearance for the vias 921 and 922. In one embodiment, the slots in the ground plane are square slots having a period half that of the elements in the layers 901, 902, 904, and 905, as shown in FIG. 9B.

In one embodiment, the surfaces 902 and 904 (and the corresponding vias 921 and 923) are omitted. In one embodiment, the surfaces 902 and 904 (and the corresponding vias 921 and 923) and the layers 911 and 914 are omitted.

Although FIGS. 9A and 9B show two FSS layers above the ground plane and two FSS layers below the ground plane, additional FSS layers can be provided above and below the ground plane. The FSS layers 901, 901, 904 and 905 are capacitive at the resonant frequency of the radome 900. Additional FSS layers provide additional capacitance as each FSS layer sis capacitive, and the capacitances of the FSS layers appear in parallel, as discussed in the text in connection with FIGS. 14–18. The slotted ground plane 903 is inductive at the resonant frequency of the radome 900. The capacitance of the FSS layers 901, 901, 904 and 905 appears in parallel with the inductance of the slotted ground plane 903 thus creating a parallel LC resonant circuit, as discussed in the text in connection with FIGS. 14–18.

The vias 921–924 (also known as posts or rods) create a rodded medium that tends to suppress surface waves in the dielectric materials. Once enough rods have been provided to achieve the desired suppression, additional rods are not needed. Thus, It is not necessary to connect the elements of all of the FSS layers to the ground plane.

In one embodiment, the elements of the FSS layer 901 are offset with respect to the elements of the FSS layer 902. In one embodiment, as shown in FIG. 9B, the offset is one half of a period in the x and y directions. This offset tends to create additional capacitance in the FSS layers.

In one embodiment, the slots in the ground plane 903 are 2.25 mm square with a period of 6 mm in a square lattice. In one embodiment, the elements of the layers 901, 902, 904 and 905 are 11.25 mm square (with the corners rebated as noted above) arranged in a square lattice with a period of 12 mm in each transverse direction. In one embodiment, the layers 901, 902, 904 and 905 and the ground plane 903 are approximately 1 mil thick. In one embodiment, the dielectric layers 911 and 914 are approximately 8 mils thick. In one embodiment, the dielectric layers 912 and 913 are approximately 60 mils thick. In one embodiment, the relative dielectric constant of the dielectric layers 911–914 is approximately 3.38.

Figure 10:
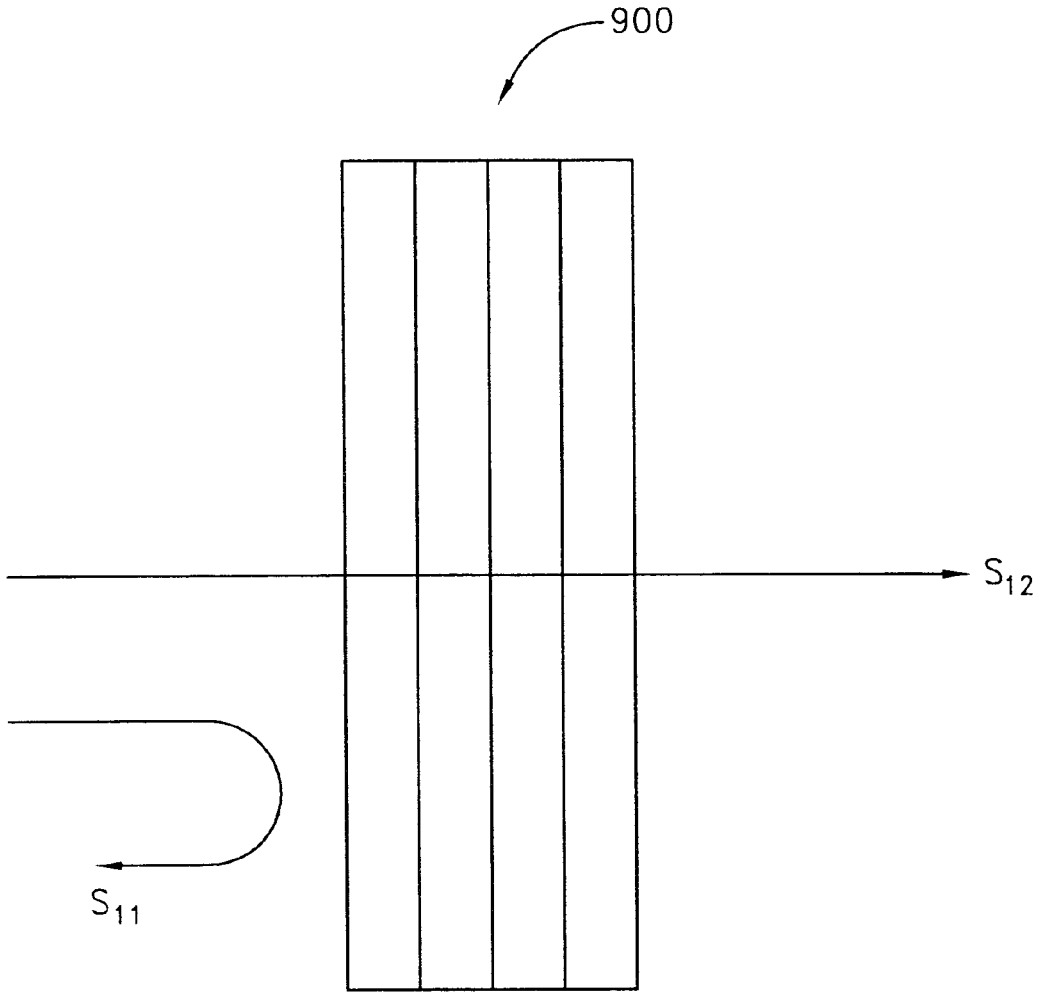
FIG. 10 illustrates transmission (S21) and reflection ($S_{11}$) from a bandpass radome.
Figure 11:
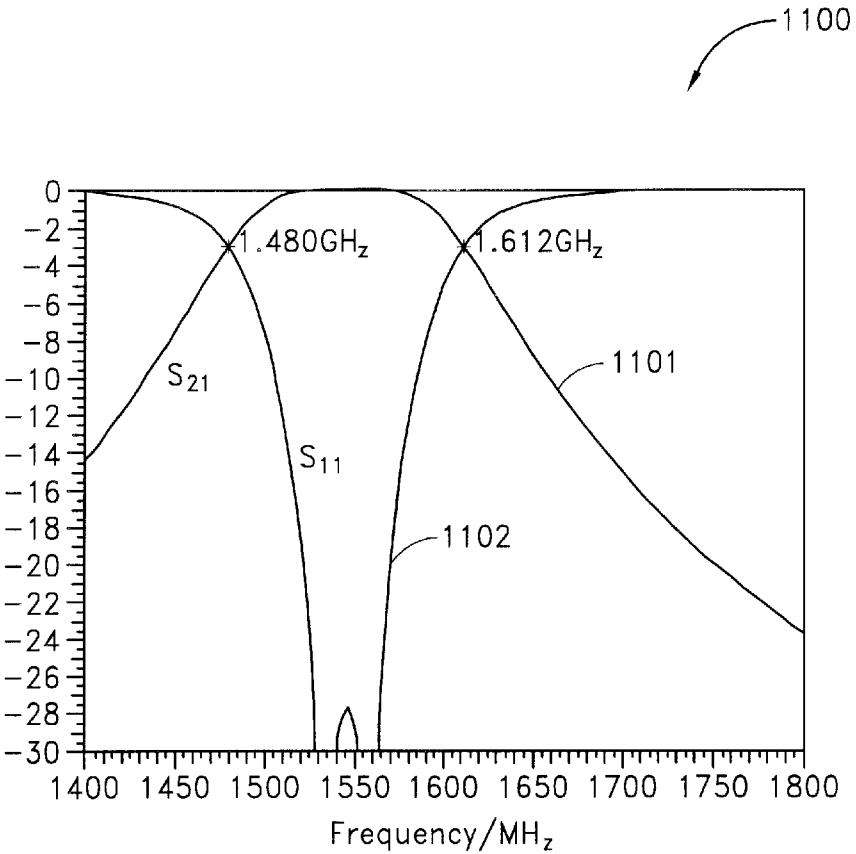
FIG. 11 shows predicted transmission and reflection for the bandpass radome of FIGS. 9A and 9B over the frequency range of 1.4 GHz to 1.8 GHz.

FIG. 10 illustrates transmission ($S_{21}$) and reflection ($S_{11}$) from the bandpass radome 900. FIG. 11 is a plot 1100 showing a predicted transmission curve $S_{21}$ 1101 and a reflection curve $S_{11}$ 1102 for the bandpass radome 900 over the frequency range of 1.4 GHz to 1.8 GHz. The curve 1101 shows a bandpass characteristic having a pass band centered at approximately 1.55 GHz. The curve 1102 shows a reflection null centered at approximately 1.55 GHz. The curves 1101 and 1102 intersect at their respective 3 dB points at 1.48 GHz and 1.612 GHz.

Figure 12:
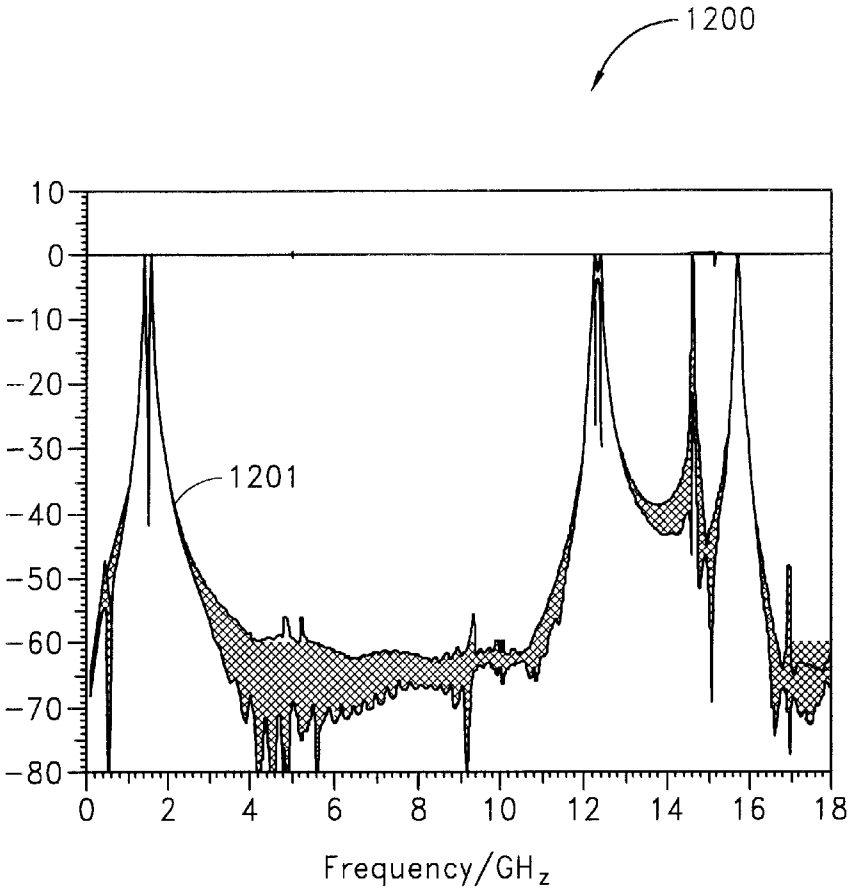
FIG. 12 shows predicted transmission and reflection near resonance for the bandpass radome of FIGS. 9A and 9B over the frequency range of 0.2 GHz to 18 GHz.

FIG. 12 is a plot 1200 showing a predicted transmission curve $S_{21}$ 1201 for the bandpass radome 900 over the frequency range of 0.2 GHz to 18 GHz. The curve 1201 shows the pass band $f_0$ at approximately 1.55 GHz with no spurious resonances (pass bands) until a first spurious pass band is reached at approximately 12.5 GHz. Thus, the curve 1201 shows that the typical spurious resonances at $3f_0$,$5f_0$ and $7f_0$ have been suppressed.

Figure 13:
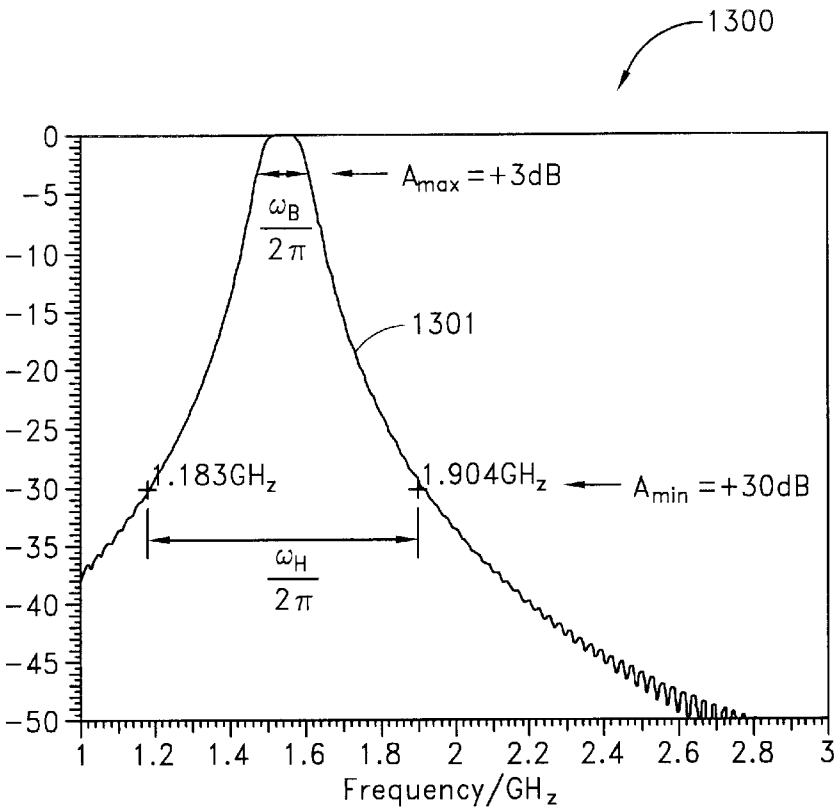
FIG. 13 illustrates calculation of the passband properties of the bandpass radome at resonance.

FIG. 13 is a plot 1300 illustrating calculation of the passband properties of the bandpass radome 900 at resonance. The plot 1300 includes a transmission curve $S_{21}$ 1301 that is similar to the curve 1101 shown in FIG. 11. The curve 1301 shows a 3 dB bandwidth $\omega_B$ and a 30 dB bandwidth $\omega W_H$ where:

$$\frac{\omega_H}{\omega_B} = \frac{1907 - 1183}{1612 - 1480} = 5.485$$

The ratio $\omega_H/\omega_B$ is a shape ratio that characterizes the bandwidth of the passband. For a Butterworth filter of order n:

$$n = \frac{\ln\left(\frac{10^{0.1A_{min}}}{10^{0.1A_{max}}}\right)}{2\ln\left(\frac{\omega_H}{\omega_B}\right)}$$

where $A_{min}$ and $A_{max}$ are measured in dB. Using the values from the curve 1301 in the above equation yields n=2.03. Thus, the curve 1301 shows a second-order Butterworth response characteristic.

It is possible to obtain a bandpass filter performance, which emulates a Chebyshev response, where the in-band ripple is non-zero. In one embodiment, the Chebyschev-type response is achieved by increasing the size of the coupling apertures 931 in the ground plane 903. Passband ripple typically increases monotonically with aperture size.

Figure 14:
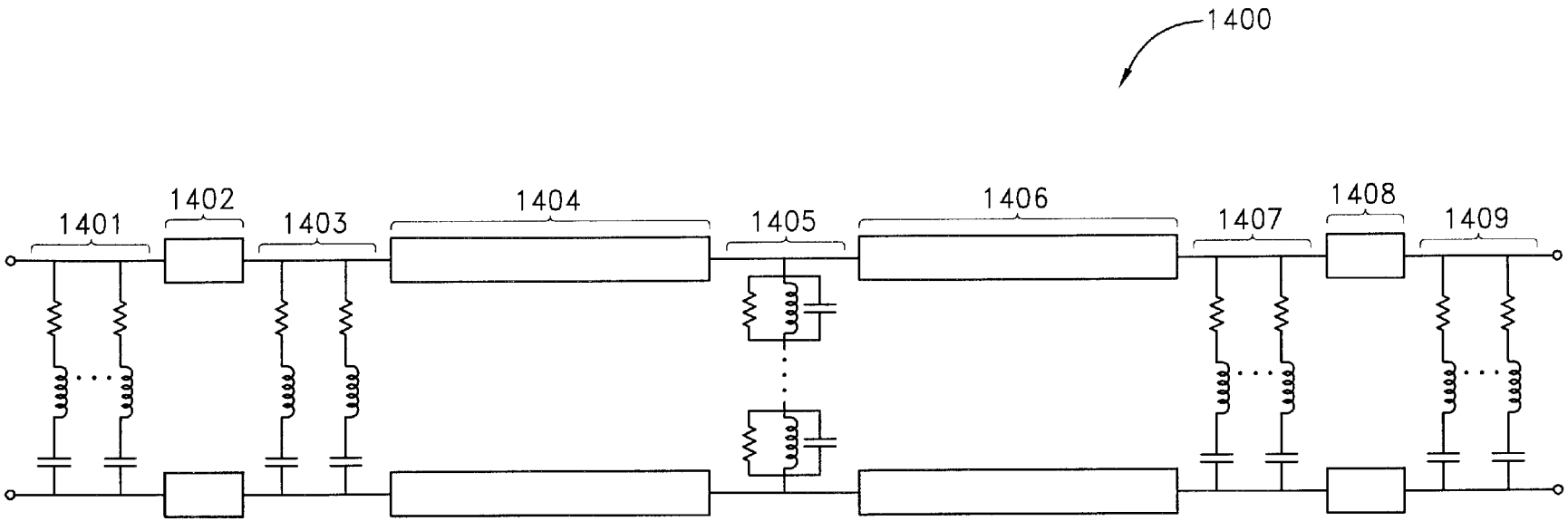
FIG. 14 is a multi-resonance equivalent circuit model of the bandpass radome of FIGS. 9A and 9B for angles near normal incidence.

Operation of the radome 900, and the Butterworth response produced by the radome 900 can be understood using equivalent circuit models. FIG. 14 shows a multi-resonance equivalent circuit model 1400 of the bandpass radome 900 for angles near normal incidence. In the model 1400, the FSS layer 901 is modeled as an equivalent circuit 1401. The equivalent circuit 1401 is a collection of series RLC circuits all connected in parallel, such that each of the RLC circuits is connected in shunt across a first end of a two-wire transmission line 1402. The transmission line 1402 models the dielectric layer 911. The transmission line 1402 has the same characteristic impedance as the dielectric layer 911, and the length of the transmission line 1402 is the same as the thickness of the dielectric layer 911. The FSS layer 902 is modeled as a circuit 1403 connected to a second end of the transmission line 1402 and to a first end of a transmission line 1404. The topology of the circuit 1403 is similar to the topology of the circuit 1401, although the actual number of RLC branches and the RLC values may be different.

The transmission line 1404 models the dielectric layer 912. The transmission line 1404 has the same characteristic impedance as the dielectric layer 912, and the length of the transmission line 1404 is the same as the thickness of the dielectric layer 912.

A second end of the transmission line 1404 is connected to a circuit 1405. The circuit 1405 models the slotted ground plane 903. The topology of the circuit 1405 is a sequence of parallel RLC circuits connected in series with each other. The series combination of parallel RLC circuits is connected in shunt across the second end of the transmission line 1404 and across a first end of a transmission line 1406.

The transmission line 1406 models the dielectric layer 913. The transmission line 1406 has the same characteristic impedance as the dielectric layer 913, and the length of the transmission line 1406 is the same as the thickness of the dielectric layer 913.

A second end of the transmission line 1406 is connected to a circuit 1407 and to a first end of a transmission line 1408. The circuit 1407 models the FSS layer 904. The topology of the circuit 1407 is similar to the topology of the circuits 1403 and 1401.

The transmission line 1408 models the dielectric layer 914. The transmission line 1408 has the same characteristic impedance as the dielectric layer 914, and the length of the transmission line 1408 is the same as the thickness of the dielectric layer 914.

A second end of the transmission line 1408 is connected to a circuit 1409. The circuit 1409 models the FSS layer 905. The topology of the circuit 1409 is similar to the topology of the circuits 1403 and 1401.

The equivalent circuits 1401, 1403, 1405, 1407, and 1409 are each shown as a sequence of RLC resonators (either series or parallel resonators). These resonators model the multiple resonances of the FSS layers, where each RLC resonator models one FSS resonance. In many cases, the FSS layer is designed to be used in a frequency range where only one of the resonances is expected to occur. In one embodiment, the passband is much lower in frequency than the resonance frequencies of the individual FSS layers 1401, 1402, 1405, 1407 and 1409.

Figure 15:
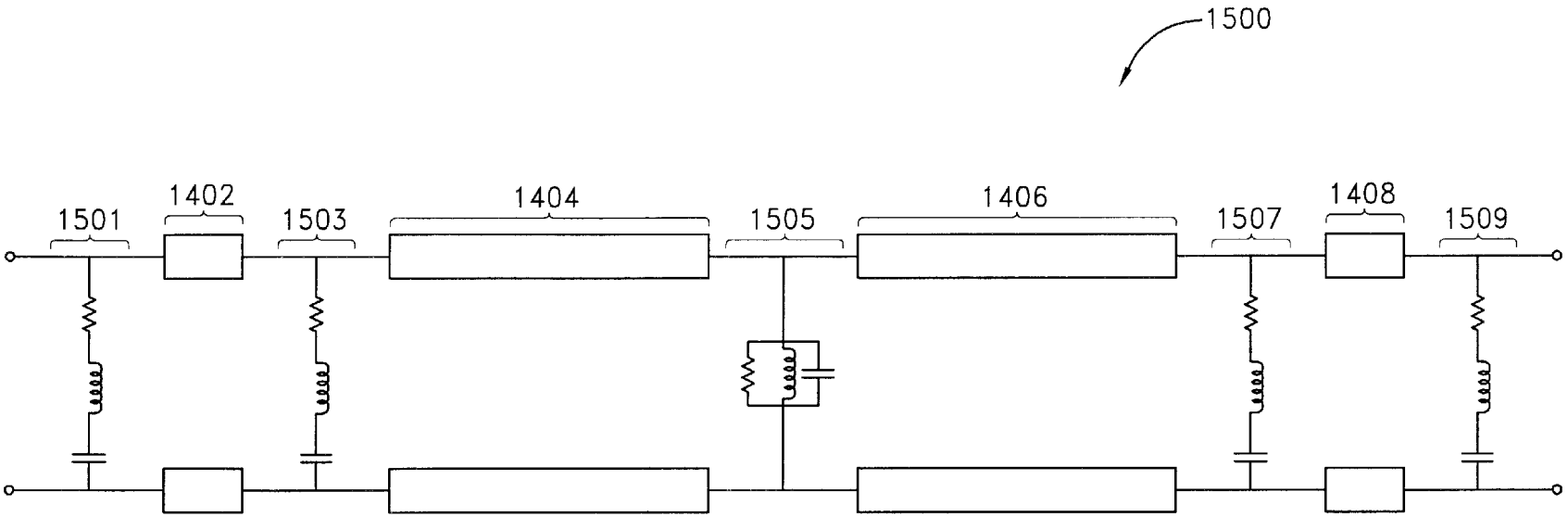
FIG. 15 is a single resonance equivalent circuit model of the bandpass radome of FIGS. 9A and 9B for angles near normal incidence.

Thus the multi-resonant equivalent circuits of FIG. 14 can be simplified as shown in FIG. 15 where each FSS layer is modeled using a single RLC resonant circuit.

FIG. 15 shows an equivalent circuit model 1500 where the circuit 1401 in FIG. 14 has been replaced by a single series RLC circuit 1501. Similarly, the circuits 1403, 1407, and 1409 have each been replaced by series RLC circuits 1503, 1507, and 1509 respectively. The circuit 1405 has been replaced by a single parallel RLC circuit 1505.

Figure 16:
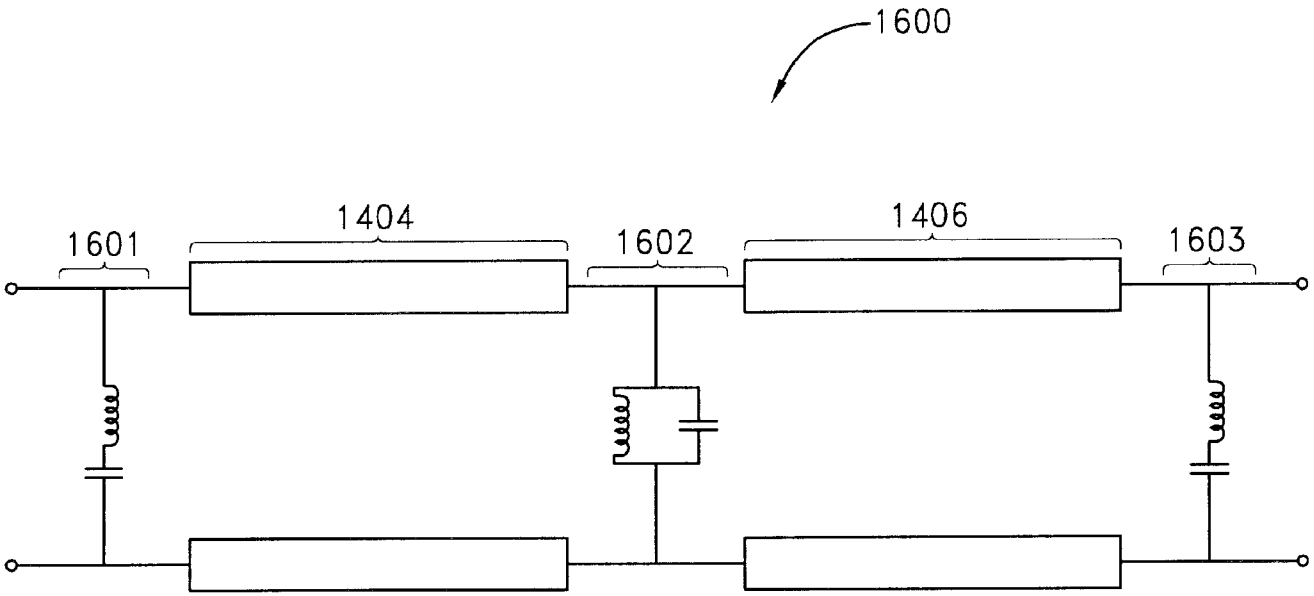
FIG. 16 is a simplified single resonance equivalent circuit model of the bandpass radome of FIGS. 9A and 9B for angles near normal incidence.

The equivalent circuit 1500 can be further simplified when the dielectric layers 911 and 914 are electrically very thin. When the dielectric layers 911 and 914 are electrically thin, then the transmission lines 1402 and 1408 can be removed from the equivalent circuit model, as shown in FIG. 16. FIG. 16 shows an. equivalent circuit 1600 where the transmission lines 1402 and 1408 have been removed, and the RLC circuits 1501 and 1503 have been combined into a single series LC circuit 1601. For modeling purposes, combining the circuits 1501 and 1503 is useful when the FSS layers 901 and 902 are electrically separated by less than $\lambda/100$. Similarly, the RLC circuits 1507 and 1509 have been combined into a single LC circuit 1603. Omitting the R from the RLC circuits is proper when the FSS layers 901 and 902 (or 904 and 905) are relatively low loss and are not operated in a frequency range where grating lobes are present.

Figure 17:
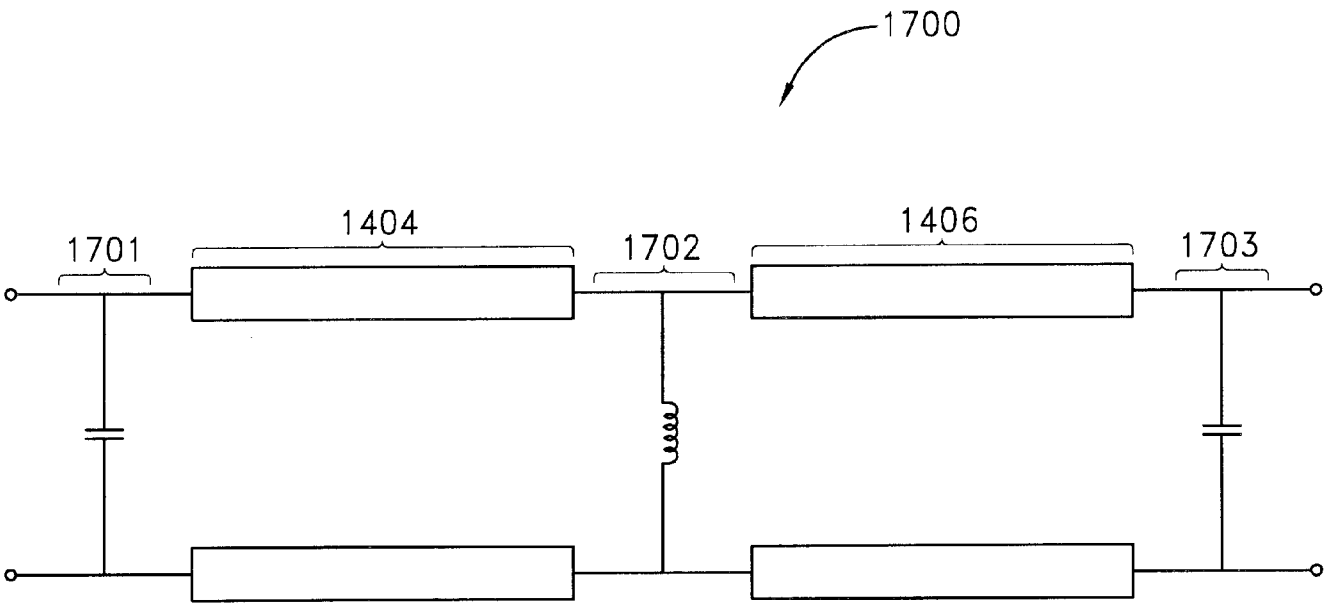
FIG. 17 is a simplified equivalent circuit model of the bandpass radome of FIGS. 9A and 9B wherein each FSS layer is represented as a single reactive element.

FIG. 17 shows a further simplification of the equivalent circuit for the radome 900. In many circumstances, the FSS layers are operated far below their actual resonance frequency. In such circumstances, the series LC circuits 1601 and 1603 appear to be essentially capacitive, and the parallel LC circuit 1602 appears to be essentially inductive. Thus, the circuit 1600 can be simplified to the circuit 1700 shown in FIG. 17. In the circuit 1700, the series LC circuits 1601 and 1603 are replaced by capacitors 1701 and 1703, and the parallel LC circuit 1602 is replaced by an inductor 1702.

Figure 18:
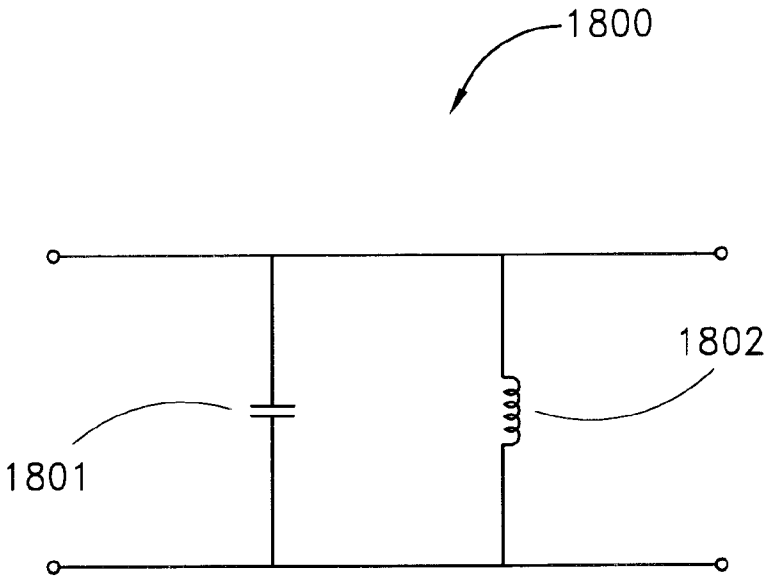
FIG. 18 is a simplified equivalent circuit model of the bandpass radome of FIGS. 9A and 9B where the dielectric layers have been ignored.

When the dielectric layers 912 and 913 are also electrically thin, then the transmission lines 1404 and 1406 can be removed as well. FIG. 18 is a simplified equivalent circuit model 1800 wherein the transmission lines 1404 and 1406 have been removed, leaving only a parallel LC circuit having a capacitor 1801 and an inductor 1802. While in some circumstances the equivalent circuit 1800 may not be accurate enough to use for final design decisions, the equivalent circuit 1800 is often accurate enough for engineering approximations near the resonance of the radome 900. In one embodiment, the transmission line sections 1404 and 1406 offer sufficient inductance so as to be larger than the inductance of 1702, and hence these transmission lines cannot be ignored for engineering approximations. Transmission lines 1404 and 1406 are also used to obtain a $2^{nd}$ order filter response.

Figure 19:
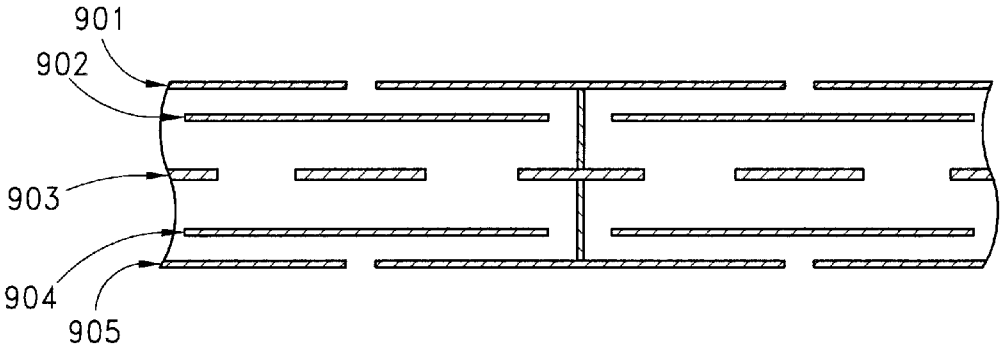
FIG. 19 shows an edge view of a bandpass radome similar to that shown in FIG. 9A, but with relatively fewer connections to the ground plane.

FIG. 19 shows an edge view of a bandpass radome 1900 similar to that shown in FIG. 9A, but with relatively fewer connections to the ground plane. The radome 1900 includes the surfaces 901–905 as shown in FIG. 9A. The radome 1900 also includes the conducting vias 922 and 924. However, in the radome 1900, the vias 921 and 923 are omitted. Thus, only the elements of the outer surfaces 901 and 905 are connected to the slotted ground plane 903.

In one embodiment, the vias 921 and 923 are included and the vias 922 and 924 are omitted, thereby connecting the surfaces 902 and 904 to the ground plane. In one embodiment, the vias 921 and 924 are included and the vias 922 and 923 are omitted, thereby connecting the surfaces 902 and 905 to the slotted ground plane 903.

Figure 20:
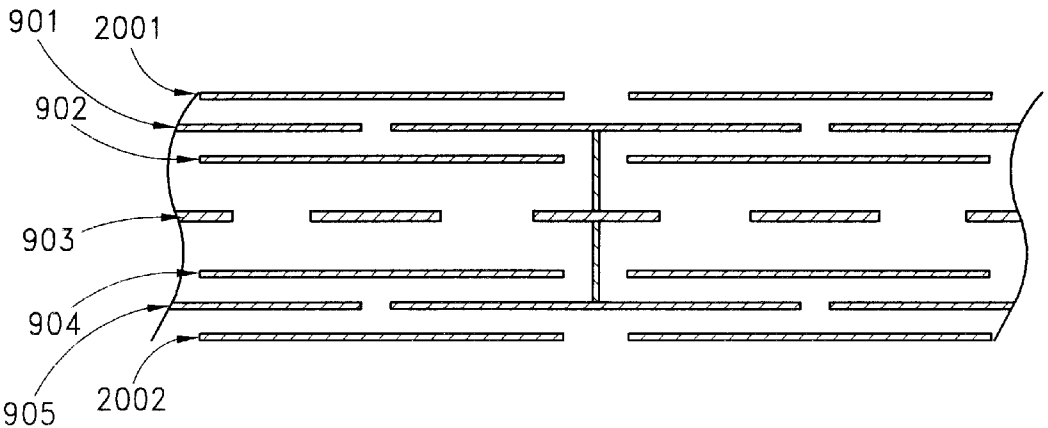
FIG. 20 shows an edge view of a bandpass radome similar to that shown in FIG. 20, with additional capacitive layers.

FIG. 20 shows an edge view of a bandpass radome 2000 similar to that shown in FIG. 20, with additional capacitive surfaces. The radome 2000 includes the surfaces 901–905. The vias 921–924 are included or omitted as described in connection with FIG. 9A or FIG. 19. One or more additional outer capacitive surfaces 2001 are provided above the surface 901. One or more additional outer capacitive surfaces 2001 are provided below the surface 2002.

When the FSS layers 901 and 905 are configured to produce sufficient capacitance, then the FSS layers 902 and 904, along with the vias 921 and 923 can be eliminated. For example, at high frequencies, the edge-to-edge capacitance per square of the FSS layers 901 and 905 alone are sufficient to realize the proper range of values for capacitors 1701 and 1703. This eliminates two of the five metal layers and reduces the manufacturing cost.

Although the foregoing has been a description and illustration of specific embodiments of the invention, various modifications and changes can be made thereto by persons skilled in the art, without departing from the scope and spirit of the invention. For example, although the FSS elements and ground plane slots are shown as being substantially square, one of ordinary skill in the art will recognize that the square shapes can be replaced with rectangles, circles, or arbitrarily shaped elements and slots. The dielectrics used in each dielectric layer can have different dielectric properties. More than two FSS layers can be placed on each side of the ground plane. The elements of some FSS layers can be connected to the ground plane, while the elements of other FSS layers can be left floating. Accordingly, the invention is defined by, and limited only by, the following claims.

What is claimed is:

1. An electrically thin bandpass radome that exhibits a reduced number of spurious resonances, comprising:

a slotted FSS ground plane layer;

a first FSS patch layer disposed above said slotted FSS ground plane layer, said first FSS patch layer comprising a first plurality of patch elements;

a second FSS patch layer disposed above said slotted FSS ground plane layer and below said first FSS patch layer, said second FSS patch layer comprising a second plurality of patch elements;

a third FSS patch layer disposed below said slotted FSS ground plane layer, said third FSS patch layer comprising a third plurality of patch elements;

a fourth FSS patch layer disposed below said third FSS patch layer, said fourth FSS patch layer comprising a fourth plurality of patch elements;

a first plurality of conducting posts connecting said first plurality of patch elements to said ground plane;

a second plurality of conducting posts connecting said second plurality of patch elements to said ground plane;

a third plurality of conducting posts connecting said third plurality of patch elements to said ground plane; and a fourth plurality of conducting posts connecting said fourth plurality of patch elements to said ground plane.

2. The radome of claim 1, further comprising a dielectric layer between said second FSS patch layer and said slotted FSS ground plane.

3. The radome of claim 1, further comprising a dielectric layer between said first FSS patch layer and said second FSS patch layer.

4. The radome of claim 1, wherein said first plurality of patches are square patches.

5. The radome of claim 1, wherein said first plurality of patches are square patches with rebated corners.

6. The radome of claim 1, wherein said first plurality of patches are rectangular patches.

7. The radome of claim 1, wherein said first plurality of patches are rectangular patches with rebated corners.

8. The radome of claim 1, wherein said first plurality of patches are round patches.

9. An apparatus, comprising: a plurality of capacitive FSS layers disposed above an inductive FSS ground plane and a plurality of capacitive FSS layers disposed below said inductive FSS ground plane, one or more of said capacitive FSS layers electrically connected to said inductive FSS ground plane by conducting posts.

10. The apparatus of claim 9, further comprising dielectric layers disposed between each of said plurality of capacitive FSS layers disposed above said inductive FSS ground plane.

11. The apparatus of claim 9, further comprising dielectric layers disposed between each of said plurality of capacitive FSS layers disposed above said inductive FSS ground plane and a dielectric layer disposed between said inductive FSS ground plane and a first capacitive FSS layer from said plurality of capacitive FSS layers that is closest to said inductive FSS ground plane.

12. A filter for electromagnetic waves, comprising:

a slotted FSS ground plane layer;

a first FSS layer disposed above said slotted FSS ground plane layer, said first FSS layer comprising a first plurality of conducting elements;

a second FSS layer disposed above said slotted FSS ground plane layer and below said first FSS patch layer, said second FSS layer comprising a second plurality of conducting elements;

a third FSS layer disposed below said slotted FSS ground plane layer, said third FSS layer comprising a third plurality of conducting elements;

a fourth FSS layer disposed below said third FSS layer, said fourth FSS layer comprising a fourth plurality of conducting elements;

a first plurality of conducting posts connecting said conducting elements of at least one of said first FSS layer and said second FSS layer to said ground plane; and a second plurality of conducting posts connecting said conducting elements of at least one of said third FSS layer and said fourth FSS layer to said ground plane.

13. The filter of claim 12, further comprising a dielectric layer between said second FSS layer and said slotted FSS ground plane.

14. The filter of claim 12, further comprising a dielectric layer between said first FSS layer and said second FSS layer.

15. The filter of claim 12, where said first plurality of conducting elements are square patches.

16. The filter of claim 12, where said first plurality of conducting elements are square patches with rebated corners.

17. The filter of claim 12, where said first plurality of conducting elements are triangular patches.

18. The filter of claim 12, wherein said first plurality of conducting elements are round patches.

19. The filter of claim 12, wherein said second FSS layer is relatively closer to said first FSS layer than to said slotted ground plane.

20. The filter of claim 12, further comprising a dielectric layer between said second FSS layer and said slotted FSS ground plane, said dielectric layer electrically thin at frequencies corresponding to a pass band of said filter.

21. The filter of claim 12, further comprising a dielectric layer between said first FSS layer and said second FSS layer, said dielectric layer electrically thin at frequencies corresponding to a pass band of said filter.

22. The filter of claim 12, further comprising one or more capacitive FSS layers disposed above said first FSS layer.

23. The filter of claim 22, further comprising one or more capacitive FSS layers disposed below said fourth FSS layer.

24. A filter for electromagnetic waves, comprising:

first means for artificially simulating a magnetic conductor across a selected frequency band;

second means for artificially simulating a magnetic conductor across said selected frequency band;

a slotted ground plane disposed between said first means and said second means;

a first plurality of conducting vias configured to connect said slotted ground plane to at least a portion of said first means; and a second plurality of conducting vias configured to connect said slotted ground plane to at least a portion of said second means.

25. A method for filtering electromagnetic waves, comprising:

illuminating an electromagnetic filter with an electromagnetic wave;

reflecting a portion of said electromagnetic wave off of said electromagnetic filter to produce a reflected wave; and transmitting a portion of said electromagnetic wave through said electromagnetic filter to produce a transmitted wave, said electromagnetic filter comprising:

a slotted ground plane layer;

at least one upper element layer disposed above said slotted ground plane layer, said at least one upper element layer comprising a plurality of conducting elements connected to said slotted ground plane by a plurality of conducting vias; and at least one lower element layer disposed below said slotted ground plane layer, said at least one lower element layer comprising a plurality of conducting elements connected to said slotted ground plane by a plurality of conducting vias.

* * * * *